US007268742B2

(12) United States Patent
Rahim

(10) Patent No.: US 7,268,742 B2
(45) Date of Patent: Sep. 11, 2007

(54) ANTENNA ARRANGEMENT

(75) Inventor: Muhammad R. Rahim, Monroeville, PA (US)

(73) Assignee: Mobile Aspects, Inc., Pittsburgh, PA (US)

( * ) Notice: Subject to any disclaimer, the term of this patent is extended or adjusted under 35 U.S.C. 154(b) by 0 days.

(21) Appl. No.: 11/378,001

(22) Filed: Mar. 17, 2006

(65) Prior Publication Data

US 2006/0214864 A1 Sep. 28, 2006

Related U.S. Application Data

(60) Provisional application No. 60/664,166, filed on Mar. 22, 2005.

(51) Int. Cl.
*H01Q 21/00* (2006.01)
*H01Q 11/12* (2006.01)
*G08B 13/14* (2006.01)

(52) U.S. Cl. ..... 343/867; 343/742; 340/572.7

(58) Field of Classification Search ..... 343/742, 343/867, 741, 866; 340/572.7
See application file for complete search history.

(56) References Cited

U.S. PATENT DOCUMENTS

| | | | | |
|---|---|---|---|---|
| 5,266,922 | A | 11/1993 | Smith et al. | |
| 6,166,706 | A * | 12/2000 | Gallagher et al. | 343/867 |
| 6,263,319 | B1 | 7/2001 | Leatherman | |
| 6,445,297 | B1 | 9/2002 | Nicholson | |
| 6,696,954 | B2 | 2/2004 | Chung | |
| 6,738,025 | B2 | 5/2004 | Carrender | |
| 6,943,688 | B2 * | 9/2005 | Chung et al. | 340/572.7 |
| 6,989,796 | B2 | 1/2006 | Rahim | |

FOREIGN PATENT DOCUMENTS

WO WO 03/090310 A2 * 10/2003

* cited by examiner

*Primary Examiner*—Shih-Chao Chen
(74) *Attorney, Agent, or Firm*—The Webb Law Firm

(57) ABSTRACT

An antenna arrangement including a first antenna module having a first antenna loop positioned in a plane for emitting a signal in a first spatial area, and at least one additional antenna loop positioned in substantially the same plane for emitting a signal in an additional spatial area. The arrangement includes at least one power source in communication with the first antenna module for providing current thereto. The first spatial area and the additional spatial area at least partially overlap, and the first antenna loop and the additional antenna loop are powered by the power source in a specified pattern. A method of identifying at least one item is also disclosed.

21 Claims, 6 Drawing Sheets

ANTENNA ARRANGEMENT

CROSS REFERENCE TO RELATED APPLICATIONS

This application claims the benefit of priority from U.S. Provisional Patent Application No. 60/664,166, filed Mar. 22, 2005, which is incorporated herein by reference in its entirety.

BACKGROUND OF THE INVENTION

1. Field of the Invention

The present invention relates generally to magnetic field applications and antenna arrangements, such as those used in radio frequency identification systems and related identification/recognition fields and, in particular, to an antenna arrangement for providing increased signal recognition and identification properties.

2. Description of the Related Art

In the field of identification and recognition systems and, for example in the field of radio frequency (RFID) identification systems, a system must be provided to allow for the communication between a reader/recognizer and an item, such as a tagged item. The identification is typically accomplished by generating a field, such as a magnetic field, capable of interacting with and communicating with an identification element, such as a tag, positioned on the item. The field can either activate or power the tag, in a passive system, or the tag may include internal power sources to facilitate communications with the system reader/recognizer. The magnetic field is typically generated by applying a current to an antenna, such as an antenna wire and the like. Accordingly, the antenna is powered and emits the field, which is used in identifying object or items within the field.

One drawback in the field and art of tag recognition, such as in the field of inventory systems, is the inability of the reader to identify tags that are positioned in "dead" areas or otherwise oriented in unreadable positions, such as perpendicular to the reader-generated field. Accordingly, there is a need in the art to provide systems with improved identification functionalities, capable of reading a tag, and therefore identifying an item, regardless of item or tag orientation or position within the system or container.

One manner of creating such improved identification characteristics is by the provision of a three-dimensional magnetic pattern. Such prior art systems, however, require complex antenna arrangements in order to produce such a field. For example, see U.S. Pat. No. 6,696,954 to Chung. In particular, these prior art systems require an antenna, positioned on each of the X-, Y- and Z-axis. One drawback to this method and arrangement is that only the tag (transponder) closest to the antennae reader has the maximum energy transfer, and in order to obtain a three-dimensional magnetic field, a cube (X-Y-Z) form is required. For example, in order to identify and read the array of transponders or tags when positioned close together a change in the transponder located by the end of the array is required, which will not otherwise be identified due to low power magnetic field in that position.

According to the prior art, FIG. 1. is a schematic illustration of a known three-dimensional loop antenna, each axis (X-Y-Z) having its own loop antenna. Tags (or transponders A1, A2, A3, B1, B2, B3, C1, C2 and C3 are positioned in this cube or box antenna arrangement, which consists of antennae A, B and C. In operation, when Antenna A is "ON", it would identify tags A1, A2, A3, and likely C1 and C3. Tag A1 receives maximum energy transfer, followed by tags A2, A3, C1 and C3. If additional "A" tags (e.g., A4, A5, A6, etc.) were positioned on top of tag A3, there remains the possibility that a change in the tag position would not be read, since the tags receive less energy transfer. Similar results would occur with respect to the remaining tags during activation of Antenna A and Antenna B. Accordingly, there remains a need in the art for an antenna arrangement that improves the accuracy and efficiencies of the recognition system.

SUMMARY OF THE INVENTION

It is, therefore, an object of the present invention to provide an antenna arrangement that overcomes the deficiencies and drawbacks evidenced in the prior art antenna arrangements in the field of recognition and inventory systems. It is another object of the present invention to provide an antenna arrangement that produces or provides a single-axis three-dimensional magnetic field that does not require a complex antenna arrangement on multiple axes. It is a still further object of the present invention to provide an antenna arrangement that produces or provides a single-axis three-dimensional magnetic field that improves tag/item identification, regardless of positioning and stacking. It is yet another object of the present invention to provide an antenna arrangement that produces or provides a single-axis three-dimensional magnetic field that provides improved energy transfer and identification/communication characteristics.

Accordingly, the present invention is directed to an antenna arrangement having a first antenna module. The first antenna module includes a first antenna loop positioned in a plane for emitting a signal in a first spatial area, and at least one additional antenna loop positioned in substantially the same plane for emitting a signal in an additional spatial area. The arrangement includes at least one power source in communication with the first antenna module for providing current. The first spatial area and the additional spatial area at least partially overlap, and the first antenna loop and the additional antenna loop are configured to be powered by the power source in specified pattern.

The present invention is also directed to an antenna arrangement having a first antenna module and a second antenna module. The first antenna module is positioned in a plane and includes a first antenna loop configured for emitting a signal in a first spatial area, and at least one additional antenna loop for emitting a signal in an additional spatial area. The first spatial area and the additional spatial area at least partially overlap. The second antenna module is substantially aligned with, positioned substantially in the same plane as and oriented at about 90° with respect to the first antenna module. Further, the second antenna module includes a first a first antenna loop for emitting a signal in a first spatial area, and at least one additional antenna loop for emitting a signal in an additional spatial area. In this second antenna module, the first spatial area and the additional spatial area at least partially overlap. The arrangement also includes at least one power source in communication with the first antenna module and the second antenna module for providing power. The first antenna loop and the additional antenna loop of the first and second antenna modules are configured to be powered by the at least one power source in specified pattern.

Further, the present invention is directed to a method of identifying at least one item. This method includes the steps of: (a) providing a first antenna loop positioned in a plane and configured to emit a signal in a first spatial area; (b) providing at least one additional antenna loop positioned in substantially the same plane and configured to emit a signal in an additional spatial area; (c) powering the first antenna loop to thereby emit a signal in a first spatial area; and (d) powering the additional antenna loop to thereby emit a signal in an additional spatial area. The first spatial area and the additional spatial area at least partially overlap, and the first antenna loop and the additional antenna loop are configured to be powered in specified pattern.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
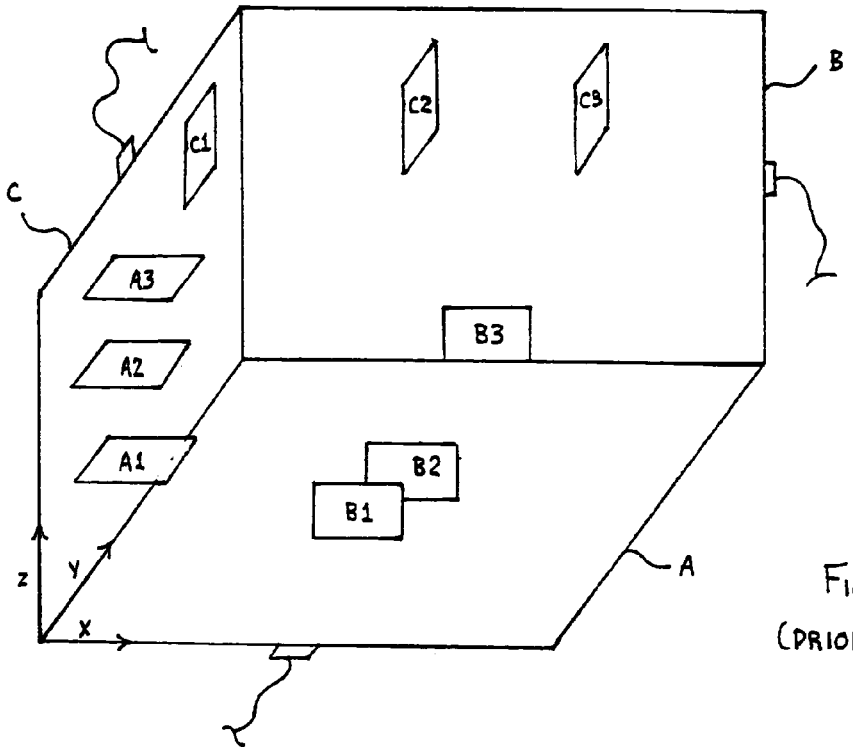
Fig. 1 (PRIOR ART)
FIG. 1 is a schematic view of an antenna arrangement and system according to the prior art.
Figure 2:
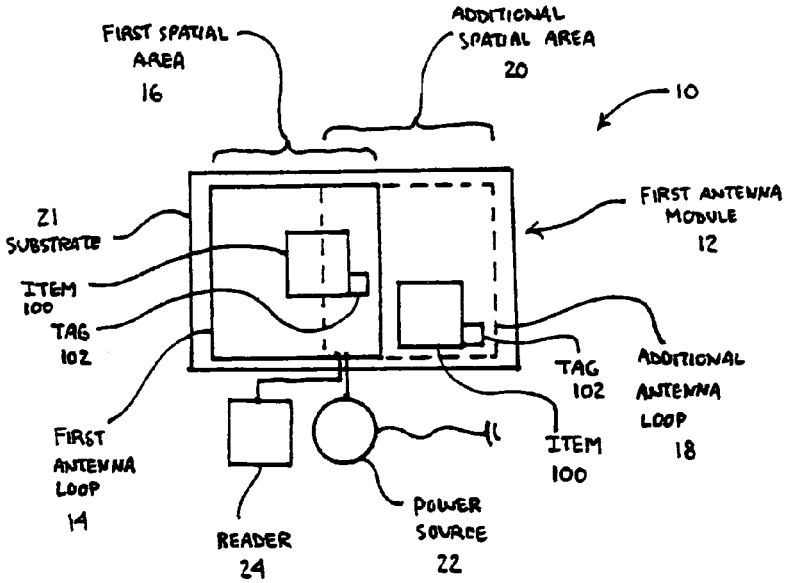
FIG. 2 is a schematic view of one embodiment of an antenna arrangement according to the principles of the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

It is to be understood that the invention may assume various alternative variations and step sequences, except where expressly specified to the contrary. It is also to be understood that the specific devices and processes illustrated in the attached drawings, and described in the following specification, are simply exemplary embodiments of the invention.

The present invention is directed to an antenna arrangement 10 and system for use in connection with recognition systems and radio frequency identification (RFID) applications. For example, the antenna arrangement 10 of the present invention is useful in connection with an inventory system that is used to identify, recognize and inventory multiple items 100, with each item 100 or groups of items 100 being in operative communication with a tag 102. The tag 102 typically includes a transponder for emitting a signal, and it is envisioned that the tags 102 can be passive tags 102, which are energized by a field emitting from a reader, such as an antenna, or an active tag, which includes its own discrete power source. The present invention is equally useful with any of these different styles and operations of tags 102, as is known in the art.

The antenna arrangement 10 includes a first antenna module 12, and this first antenna module 12 includes a first antenna loop 14, which is positioned in a plane and configured to emit a signal in a first spatial area 16. In addition, the first antenna module 12 includes at least one additional antenna loop 18, which is positioned substantially in the same plane as the first antenna loop 14. Further, as with the first antenna loop 14, the additional antenna loop 18 is configured to emit a signal in an additional spatial area 20. Still further, the first spatial area 16 and the additional spatial area 20 at least partially overlap. Both the first antenna loop 14 and the additional antenna loop 18 may be positioned on a common and substantially planar substrate 21.

In order to emit a signal or field, the first antenna loop 14 and the additional antenna loop 18 are in operative communication with and powered by a power source 22. In particular, the power source 22 provides current to the antenna loop 14, 18, causing the antenna loop 14, 18 to emanate a signal or field and, thereby, activate the tag 102 attached to the item 100. Accordingly, regardless of whether the tag 102 is an "active" tag or a "passive" tag, the signal emitted from the tag 102 (or the transponder) is captured by the first antenna loop 14 and/or the additional antenna loop 18 and transferred to a reader 24.

Due to the overlapping antenna loops 14, 18 and, consequently, spatial areas 16, 20, the resulting coverage of the field or signal emitted from the antenna loops 14, 18 is maximized. In addition, the antenna loops 14, 18 are "activated" or "powered" according to a specified pattern. For example, in one embodiment, the first antenna loop 14 is activated and obtains signals from tags 102 within its first spatial area 16, and subsequently and serially, the additional antenna loop 18 is activated and receives signals from the tags 102 in the additional spatial area 20. Since the first spatial area 16 and additional spatial area 20 overlap, the tags 102 that are placed in a "dead spot" or low probability reading area in one of these spatial areas 16, 20, are read or identified due to its relative position in the other spatial area 16, 20. In this manner, by switching, alternating or otherwise activating in a specified pattern the antenna loops 14, 18, the accuracy of the antenna arrangement 10 is greatly improved. Of course, there will often be tags 102 that are positioned such that they are identified by both antenna loops 14, 18. However, the reader 24 includes the appropriate resolution software or circuitry to remove duplicate identifications, as well as recognize non-identifications.

Figure 3:
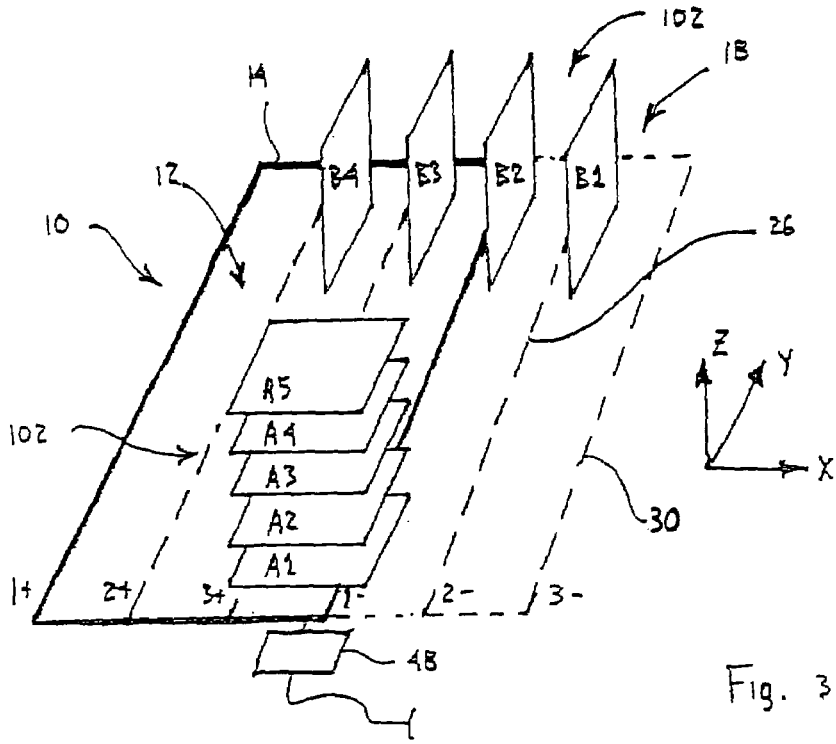
FIG. 3 is a schematic view of one embodiment of an antenna arrangement according to the principles of the present invention.
Figure 4:
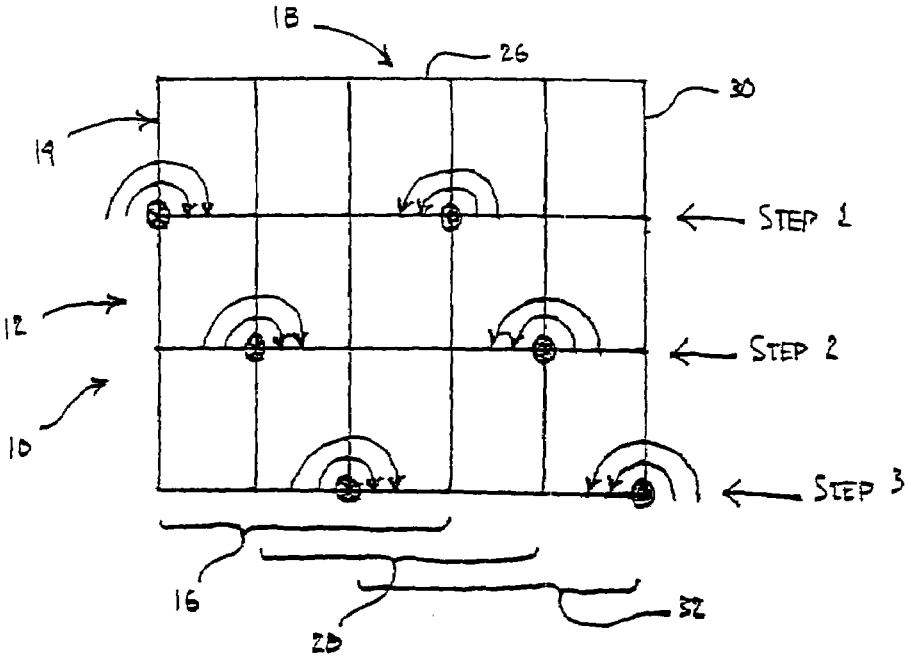
FIG. 4 is a schematic view of the antenna arrangement of FIG. 3 in operation.

An embodiment using three antenna loops (i.e., the first antenna loop 14 and two additional antenna loops 18) is illustrated in FIGS. 3 and 4. As seen in these figures, the first antenna loop 14 overlaps both a second antenna loop 26 and a third antenna loop 30. Accordingly, as seen in FIG. 4, the first spatial area 16 overlaps a second spatial area 28 and a third spatial area 32. In addition, multiple tags 102 are positioned in these various spatial areas 16, 28, 32. In particular, the present embodiment illustrates the antenna arrangement 10 used in connection with tags A1, A2, A3, A4, A5, B1, B2, B3 and B4. Normally, each of these tags 102 would be associated with a particular and unique item 100. Due to the movement of power or current through each antenna loop 14, 26, 30, such movement is represented by a positive (+) and negative (−) symbol. Accordingly, the first antenna loop 14 is identified by a 1+ and 1−, the second antenna loop 26 is identified by a 2+ and a 2−, and the third antenna 30 is identified by a 3+ and a 3−.

In operation, and as best seen in FIG. 4, when the first antenna loop 14 is activated or switched "ON", the first antenna module 12 (or antenna arrangement 10) would identify tags A1, A2 and A3; possibly identify tags A4 or A5, B2 and B3; and likely would not identify B1, B4, A4 and A5. The activation of the first antenna loop 14 is represented as Step 1 in FIG. 4.

Next, in Step 2 in FIG. 4, the second antenna loop 26 is activated or switched "ON". When the second antenna loop 26 is activated, the first antenna module 12 would identify tags A1, A2 and A3; and likely identify tags A4 and A5, B4, B3 and B1. Finally, in Step 3, the third antenna loop 30 is switched "ON". During activation, in this step, the first antenna module 12 would identify tags A1, A2 and A3; and likely identify tags A4 and A5, and B3. Therefore, after the Steps 1-3, all of the tags 102 in the X-Y and Y-Z orientation would be identified. The placement of additional antenna loops 18 and corresponding exact placement and positioning in an overlapping manner would allow for the identity of feasibly all of the tags 102 in the system. In operation, the process or steps would continue with the remaining additional antenna loops 18, although it is noted that additional processing time would be required to complete the cycle of the antenna ON/OFF process, which would increase costs, but also effectiveness.

Figure 5:
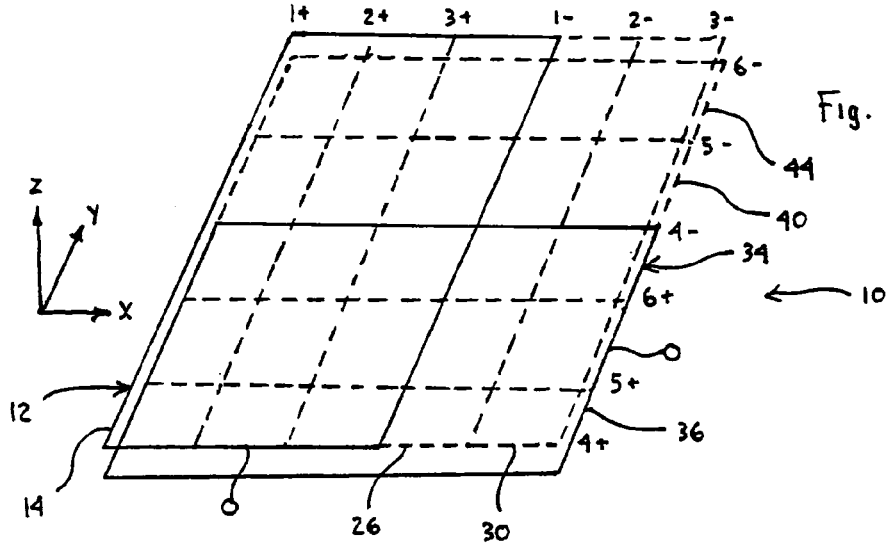
FIG. 5 is a schematic view of another embodiment of an antenna arrangement according to the principles of the present invention.

In order to more effectively identify tags 102 positioned in the X-Y orientation, a second antenna module 34 could be utilized. This second antenna module 34 (together with the first antenna module 12) is illustrated in FIG. 5, and in operation in FIGS. 6 and 7. In particular, the second antenna module 34 includes multiple antenna loops that are arranged and interact as discussed above in connection with the first antenna module 12. However, the second antenna module 34, and specifically the antenna loops of the second antenna module 34, are positioned substantially in the same plane as and oriented at about 90 degrees with respect to the first antenna module 12. Accordingly, the second antenna module 34 can be placed on, near, adjacent or in operative communication with the substrate 21, but the orientation is rotated 90 degrees with respect to the first antenna module 12. Further, the first antenna module 12 and the second antenna module 34 may be in a stacked relationship, such that the first antenna module 12 and the second antenna module 34 are substantially immediately adjacent each other. However, it is envisioned the second antenna module 34 could be co-planar with and spaced from the first antenna module 12.

Figure 6:
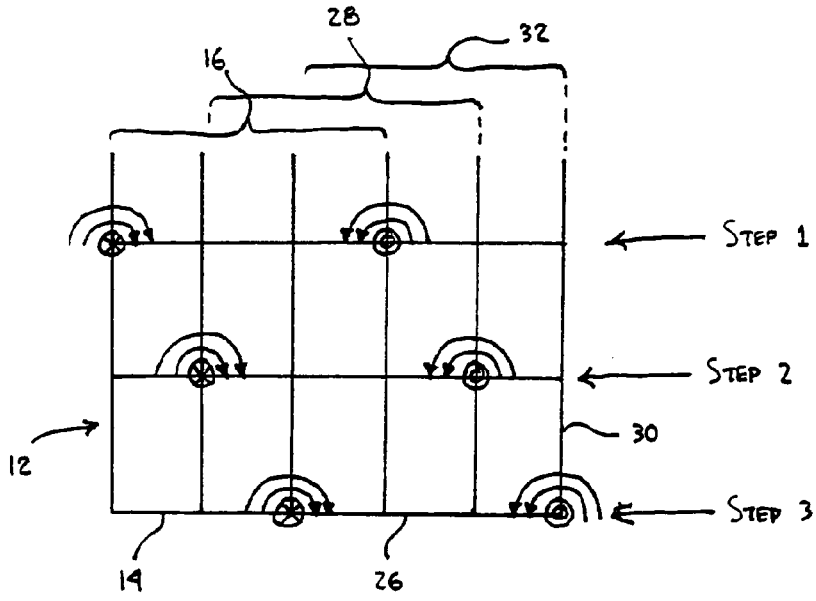
FIG. 6 is a schematic view of the antenna arrangement of FIG. 5 in operation.
Figure 7:
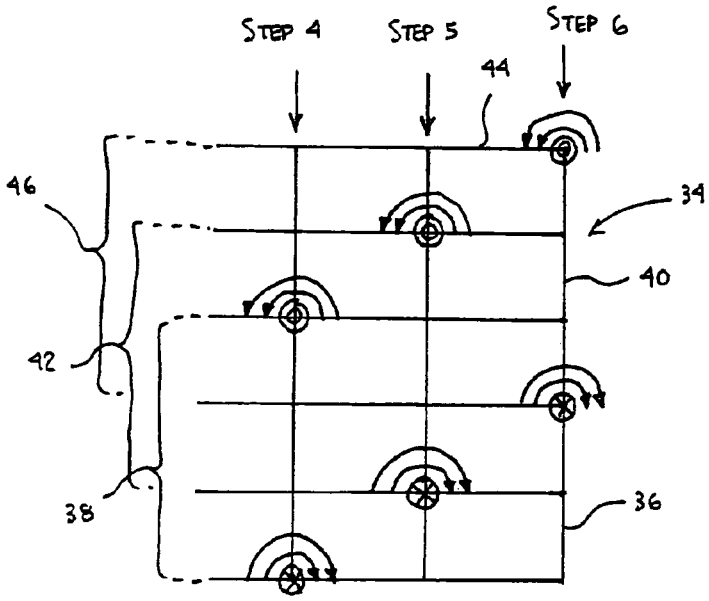
FIG. 7 is a further schematic view of the antenna arrangement of FIG. 5 in operation.

In the embodiment of FIGS. 5-7, the second antenna module 34 includes a fourth antenna loop 36 emitting a signal in a fourth spatial area 38, a fifth antenna loop 40 emitting a signal in a fifth spatial area 42, and a sixth antenna loop 44 emitting a signal in a sixth spatial area 46. Accordingly, as above, each of the antenna loops 36, 40, 44 are represented by a positive and negative current flow path. In operation, and as shown in FIG. 6, Steps 1-3 (as discussed above) again occur in this embodiment. Therefore, the first antenna loop 14, the second antenna loop 26 and the third antenna loop 30 are activated or switch "ON" in sequential manner. Again, this process would certainly identify all tags 102 in the X-Y and Y-Z orientation or plane.

Further, in this embodiment, and as with the first antenna module 12, the fourth spatial area 38, fifth spatial area 42 and sixth spatial area 46 all overlap each other and are also operated or "read" in a sequential or serial pattern. Therefore, as seen in FIG. 7, in Step 4 the fourth antenna loop 36 is activated or switched "ON", followed by Step 5 (activating the fifth antenna loop 40) and Step 6 (activating the sixth antenna loop 44). Due to the orientation of the first antenna module 12 and second antenna module 34 with respect to each other, namely 90 degree rotation, and due to the resulting rotation of the fields projected from the antenna loops 14, 26, 30, 36, 40, 44, a three-dimensional magnetic field is created. Using the second antenna module 34, all of the tags 102 (or transponders) having the Y-X orientation are identified. Accordingly, without using specifically oriented cube-type complex antenna systems and arrangements, the use of the 90-degree orientation between the first antenna module 12 and the second antenna module 34 achieves the same three-dimensional effect to recognize any tag 102 (and therefore, any item 100) in the system.

It is envisioned that Steps 1-6 can be performed in any suitable manner. For example, as seen in FIG. 5, both the first antenna loop 14 and the fourth antenna loop 36 are activated or switched "ON" at the same time. This allows the reader 24 to much more quickly identify the tags 102 that the antennae are capable of identifying. Any number of patterns is envisioned for activation of the antennae of the first antenna module 12 and second antenna module 34. However, the activation sequence or pattern should be adjusted to ensure that none of the magnetic fields generated by the antennae cancel each other out or have any other negative effects on the identification properties and characteristics of the present invention.

Figure 8:
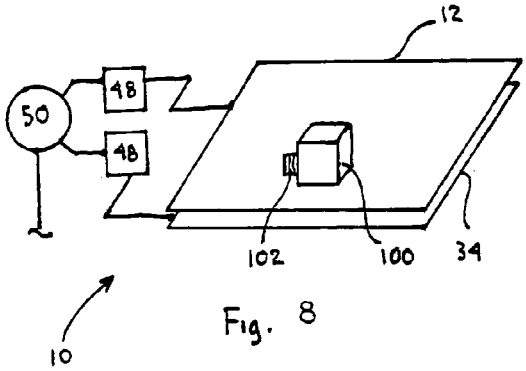
FIG. 8 is a schematic view of another embodiment of an antenna arrangement according to the principles of the present invention.

Another embodiment of the antenna arrangement 10 of the present invention is illustrated in FIG. 8. In this embodiment, the first antenna module 12 and second antenna module 34 are each utilized, and each antenna module 12, 34 is in communication with a corresponding matching board 48. Each matching board 48 is in communication with a single power splitter 50, which acts as the power source 22 for providing current to the respective antennae in the first antenna module 12 and second antenna module 34. In this preferred and non-limiting embodiment, each antenna module 12, 34 includes a 50 Ohm impedance connection to a transmission line or power source via the two-way zero-degree radio frequency power splitter 50. The use of the power splitter 50, together with a corresponding matching board 48 for each antenna module 12, 34 provides improved scanning time in a parallel environment, where the antennae are positioned in a grid form and include the same radio frequency phase. In addition, as discussed above, the first antenna module 12 and second antenna module 34 (and in particular the antennae in these modules 12, 34) are oriented perpendicularly at 90 degrees with respect to each other, which, as discussed above, achieves this three-dimensional magnetic field.

Figure 9:
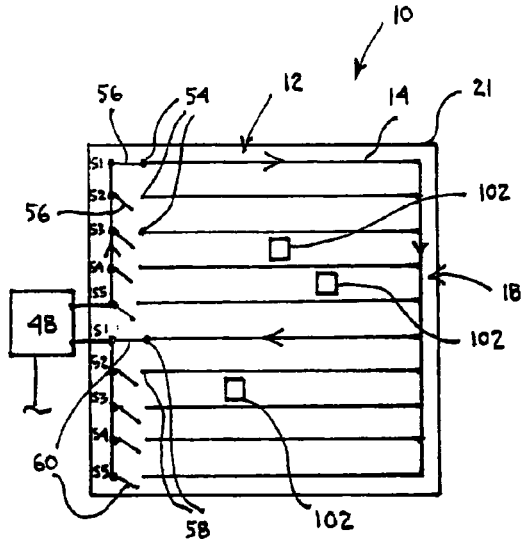
FIG. 9 is a schematic view of a further embodiment of an antenna arrangement according to the principles of the present invention.

In another embodiment, and as illustrated in FIG. 9, the antenna arrangement 10 may utilize a high-speed radio frequency switching arrangement, which includes control and timing functions to create a full multiple single-loop antennae arrangement, where each antenna could be activated in an ON-OFF sequence by an antenna controller 52. As seen in FIG. 9, five antennae are used, and the first antenna loop 14 is shown in the "ON" position. Each antenna loop includes an entry end 54 in communication with an entry switch 56, as well as an exit end 58 in communication with an exit switch 60. The switches 56, 60 are closed in unison, thereby providing current to the created antenna loop. When used in the above-discussed serial pattern, the entry switch 56 and corresponding exit switch 60 of the first antenna loop 14 would be opened or set to the "OFF" position, and the next entry switch 56 and exit switch 60 would be closed on the second antenna loop. In this manner, the first antenna loop 14 and additional antenna loops 18 could be switched "ON" and "OFF" and serially energized to read the tags 102.

Figure 10:
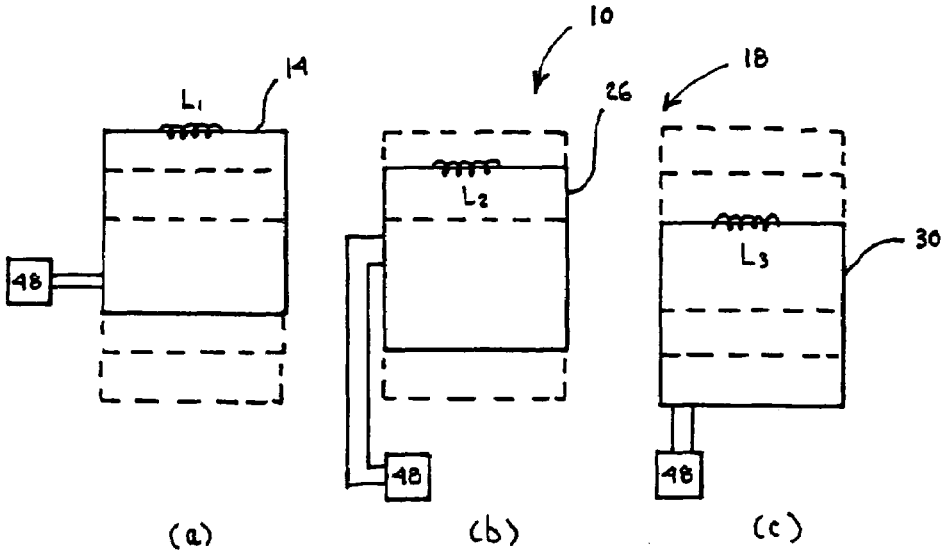
FIG. 10 is a schematic view of a still further embodiment of an antenna arrangement according to the principles of the present invention.

FIG. 10 illustrates an embodiment of the antenna arrangement 10 of the present invention and includes the first antenna module 12 having the first antenna loop 14, second antenna loop 26 and third antenna loop 30. Each loop is in communication with a matching board 48. As demonstrated in FIG. 10, each antenna loop 14, 26, 30 in the first antenna module 12 may include the same inductance to allow a single matching circuit for all antennae. Such an arrangement would prevent the requirement to use a separate matching circuit for each loop 14, 26, 30, which may be expensive and complex in arrangement. Accordingly, every antenna loop 14, 26, 30 in this embodiment has the same inductance, which is represented by L1=L2=L3 . . . .

Figure 11:
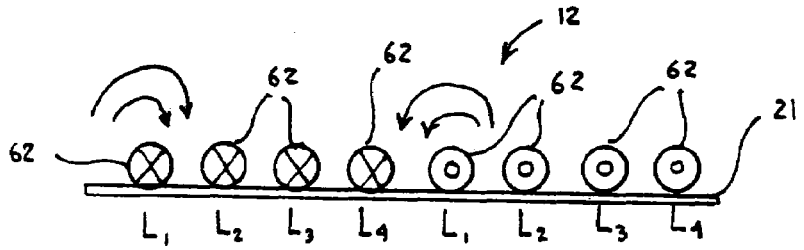
FIG. 11 is a schematic view of another embodiment of an antenna arrangement according to the principles of the present invention in operation.

FIG. 11 illustrates the magnetic field appearance during operation of the first antenna module 12. Accordingly, as discussed above, each antenna module 12, 34, includes the first antenna loop 14 and at least one additional antenna loop 18. These loops 12, 18 may be parallel to each other, as long as they are in the same phase. Such an arrangement would create a two-dimensional axis magnetic field near the respective antenna wire 62. The use of this phase-consistent magnetic field provides one key to providing a full-size two-dimensional magnetic field antenna module 12, where the antenna loops 14, 26 are sequentially switched from one side to the other in order to cover the entire area, such as the area of the substrate 21 upon which the antenna module 12 is disposed. Also, as discussed above, a three-dimensional axis magnetic field would be created by using the second antenna module 34 oriented perpendicularly or 90 degrees with respect to the first antenna module 12.

Figure 12:
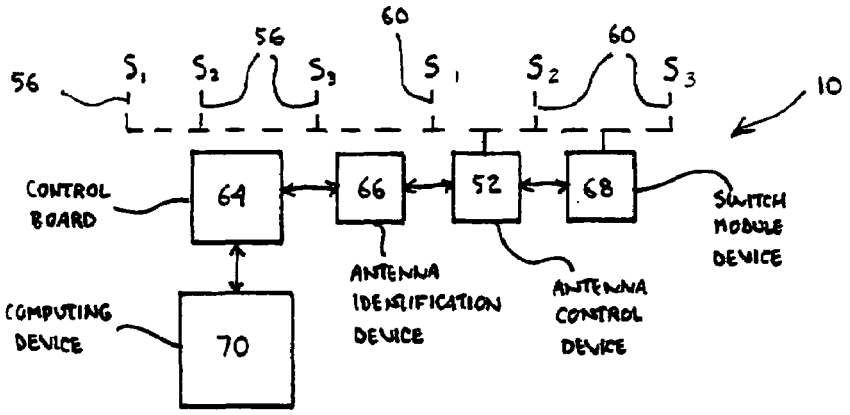
FIG. 12 is a schematic view of a further embodiment of an antenna arrangement according to the principles of the present invention.

As seen in FIG. 12, a grid of wire 62 can be used to form any number, arrangement and shape of antenna loops and may be used to construct a full-form relay-driven radio frequency antenna arrangement 10. Each relay or switch 56, 60 could be controlled by the antenna controller 52. Additional control by the user can be obtained by using a control board 64 and an antennae identification device 66. The control board 64 could broadcast a signal to all antenna modules 12, 34 and, based upon the identification of the appropriate antenna loop 14, 18 or antenna module 12, 34, the appropriate response to the signal would be obtained. Accordingly, each antenna loop 14, 18 could be uniquely identified and turned "ON" by the antenna control device 52 issuing a command to start the sequential looping operation or switching to a switch module device 68. In addition, it is envisioned that the antenna arrangement 10, including the antenna control device 52, control board 64, antenna identification device 66, switch module device 68, matching board 58, power splitter 50, power source 22, etc. could be controlled through a computing device 70, such as a personal computer having the appropriate circuitry, software or programs loaded thereon.

Figure 13:
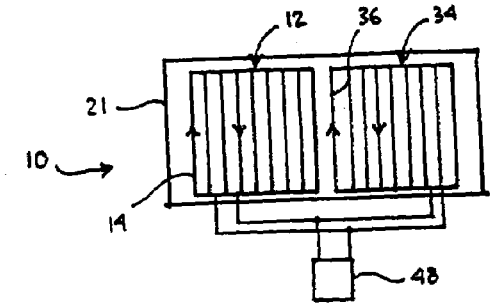
FIG. 13 is a schematic view of another embodiment of an antenna arrangement according to the principles of the present invention.

The scan time for a large area, such as a large substrate 21 having many items 100 (and corresponding tags 102) thereon could be decreased. Specifically, as seen in FIG. 13, two antenna modules 12, 34, could be parallel and horizontally spaced from each other and disposed on the same substrate 21. Using a common matching board 48, the first antenna loop 14 of each module 12, 34 could be activated simultaneously, and each additional antenna loop 18 of each antenna module 12, 34 could be subsequently (and simultaneously with each other) activated. Accordingly, this scanning or "reading" time of the arrangement 10 would proceed much more quickly.

Figure 14:
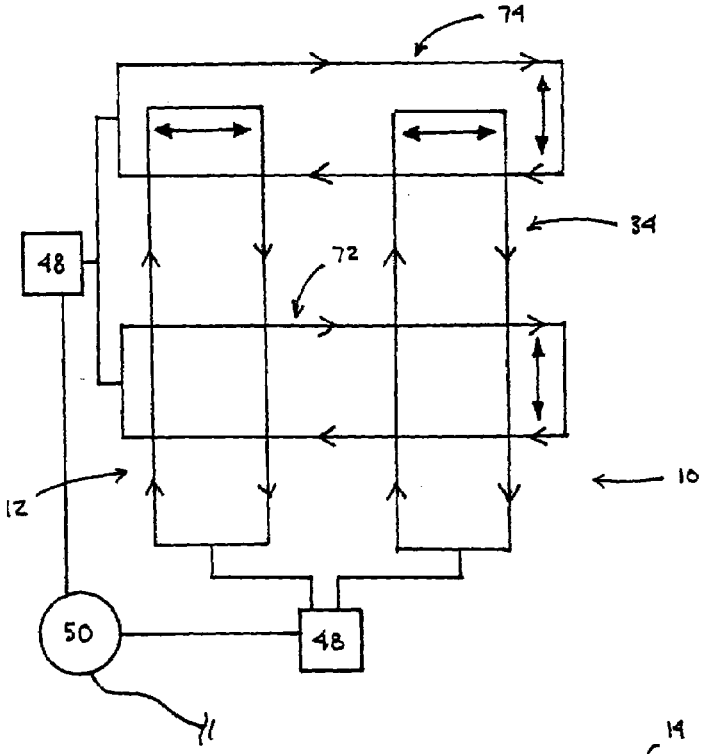
FIG. 14 is a schematic view of a further embodiment of an antenna arrangement according to the principles of the present invention.

Another preferred and non-limiting embodiment is illustrated in FIG. 14. As shown in this figure, upper and bottom layers could be turned "ON" at the same time with the same radio frequency phase. Such an arrangement allows for an increase in reading or scanning time, as well as the ability to control the impedance. In this embodiment, each antenna module 12, 34 includes its own matching board 48, which is connected to a transmission line (e.g., coaxial cable) via the two-way power splitter 50. In this manner, each antenna loop, which is controlled by the antenna control device 52, could move the magnetic field electronically without the requirement for any moving parts. In particular, and as discussed in connection with the previous embodiment, the antenna modules 12, 34 are horizontally spaced and substantially coplanar with each other.

Further, in this embodiment, a third antenna module 72 and a fourth antenna module 74 are positioned under or in a stacked relationship with respect to the first and second antenna modules 12, 34. In addition, the third antenna module 72 and fourth antenna module 74 are horizontally spaced and substantially coplanar with each other. The embodiment of FIG. 14 illustrates the use of four antenna modules 12, 34, 72, 74, where the third and fourth antenna modules 72, 74 are vertically aligned with and in a 90-degree rotated positioned with respect to the first and second antenna modules 12, 34. Accordingly, the three-dimensional field is generated simultaneously in parallel portions of the scanning area, such as the substrate 21. Any number of such arrangements are envisioned.

In a single wave switching module, a larger amplitude is obtained, as well as a larger field strength. In a double wave switching arrangement, which uses a power splitter 50, a smaller amplitude is obtained, which results in a decreased field strength, however the reading or scanning time will be much improved. Therefore, balance between the field strength and the timing requirements can be tailored depending upon the operational requirements and application of the antenna arrangement 10. For instance, to track a small item 100, such as a pharmacy bottle or the like, the field strength will be a priority over the scanning or reading time. However, for a big item 100, which exhibits excellent energy transfer between the tag 102 and the antennae (as bigger items 100 use bigger tags 102), the reduction in scanning or reading time will take priority.

Figure 15:
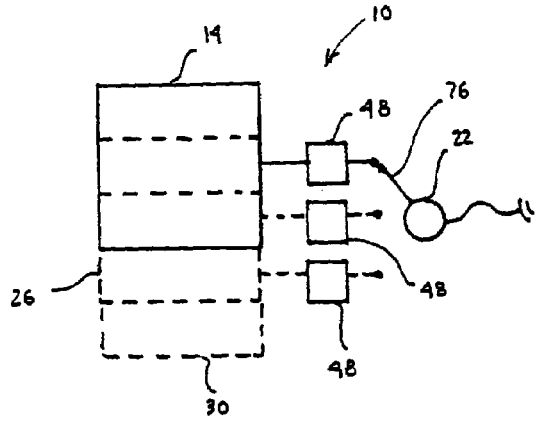
FIG. 15 is a schematic view of a still further embodiment of an antenna arrangement according to the principles of the present invention.

Yet another embodiment is illustrated in FIG. 15. In this preferred and non-limiting embodiment, three antenna loops are used, namely the first antenna loop 14, the second antenna loop 26 and the third antenna loop 30. Each antenna loop is in communication with a respective matching board 48. In addition, each matching board 48 is in communication with a power source 22 (such as a transmission line or the like) via a matching board switch 76. Accordingly, as opposed to switching the antenna loops 14, 26, 30 using the entry switch 56 and exit switch 60, the switching in this embodiment occurs prior to power or current flowing to the matching board 48 and antenna loops 14, 26, 30.

Accordingly, the present invention provides an antenna arrangement 10 and system having improved identification characteristics and which allows for the identification of target transponders or tags 102 in every position. In addition, the present invention provides a uniform three-dimensional magnetic pattern having a high-powered magnetic field. As discussed above, prior art cube-based and complex antenna arrangement do not produce this required power for such an application. The presently-invented antenna arrangement 10 dynamically modifies the antenna wire position closest to the tag 102, which provides maximum energy transfer. In addition, the combination of multiple antennae, antenna "ON"/"OFF" controls, in-phase and out-of-phase controls, together with temporal controls, produces this required field. Still further, the antenna arrangement 10 of the present invention allows for the modification of the antenna wire form and position, as well as phase manipulation as a substantially static process, which does not require any moving parts. In addition, the antenna arrangement 10 and system may be controlled by an antenna control device 52, computing device 70, etc., thereby providing an arrangement having control characteristics that require a singularly planar antenna system that produces this three-dimensional magnetic field.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. An antenna arrangement, comprising:

a first antenna module, including:

a first antenna loop positioned in a plane and configured to emit a signal in a first spatial area;

at least one additional antenna loop positioned in substantially the same plane and configured to emit a signal in an additional spatial area; and at least one power source in communication with the first antenna module and configured to provide current thereto;

wherein the first spatial area and the additional spatial area at least partially overlap;

wherein the first antenna loop and the additional antenna loop are configured to be powered by the power source in specified pattern;

wherein the at least one additional antenna loop comprises a plurality of additional antenna loops, each having a respective additional spatial area, each spatial area overlapping with at least one other spatial area.

2. The antenna arrangement of claim 1, wherein ends of at least one of the first antenna loop and the additional antenna loops are in communication with a respective switch, such that, when the switches are closed, current flows to and around the antenna loop.

3. The antenna arrangement of claim 2, wherein the ends include a entry end in communication with an entry switch and an exit end in communication with an exit switch, such that, when the switches are closed, current flows around the antenna loop.

4. The antenna arrangement of claim 1, further comprising a matching board in communication with the first antenna loop and the additional antenna loops, through which power from the power source is transmitted.

5. The antenna arrangement of claim 1, wherein the first antenna loop and at least one of the additional antenna loops are disposed on a common planar substrate.

6. The antenna arrangement of claim 1, wherein the pattern is a sequential and serial pattern.

7. The antenna arrangement of claim 1, further comprising a computing device in communication with the at least one power source, the first antenna module, the first antenna loop, the at least one additional antenna loop, a switch, a switch module device, a power splitter, a control board, an antenna control device, an antenna identification device, a matching board, a reader or any combination thereof.

8. The antenna arrangement of claim 1, further comprising a matching circuit in communication with the first antenna module and configured to transmit current from the power source thereto and receive signals from the first antenna module for further transmission.

9. The antenna arrangement of claim 1, further comprising:

a second antenna module including a first antenna loop configured to emit a signal in a first spatial area and at least one additional antenna loop configured to emit a signal in an additional spatial area; wherein the first spatial area and the additional spatial area at least partially overlap;

a third antenna module including a first antenna loop configured to emit a signal in a first spatial area and at least one additional antenna loop configured to emit a signal in an additional spatial area; wherein the first spatial area and the additional spatial area at least partially overlap; and a fourth antenna module including a first antenna loop configured to emit a signal in a first spatial area and at least one additional antenna loop configured to emit a signal in an additional spatial area; wherein the first spatial area and the additional spatial area at least partially overlap;

wherein the second antenna module is coplanar with and spaced from the first antenna module, at least one antenna loop of the first antenna module and at least one antenna loop of the second antenna module powered substantially simultaneously;

wherein the fourth antenna module is coplanar with and spaced from the third antenna module, at least one antenna loop of the third antenna module and at least one antenna loop of the fourth antenna module powered substantially simultaneously.

10. The antenna arrangement of claim 1, further comprising a reader configured to receive identification signals transmitted through the first antenna loop, the at least one additional antenna loop or any combination thereof.

11. An antenna arrangement, comprising:

a first antenna module, including:

a first antenna loop positioned in a plane and configured to emit a signal in a first spatial area;

at least one additional antenna loop positioned in substantially the same plane and configured to emit a signal in an additional spatial area, wherein the first spatial area and the additional spatial area at least partially overlap;

at least one power source in communication with the first antenna module and configured to provide current thereto, wherein the first antenna loop and the additional antenna loop are configured to be powered by the power source in specified pattern; and a second antenna module including a first antenna loop configured to emit a signal in a first spatial area and at least one additional antenna loop configured to emit a signal in an additional spatial area; wherein the first spatial area and the additional spatial area at least partially overlap.

12. The antenna arrangement of claim 11, wherein the second antenna module is aligned with, positioned substantially in the same plane as and oriented at about 90° with respect to the first antenna module.

13. The antenna arrangement of claim 12, wherein the first antenna module and the second antenna module are in a stacked relationship, such that the first antenna module and the second antenna module are substantially immediately adjacent with each other.

14. The antenna arrangement of claim 11, wherein the second antenna module is coplanar with and spaced from the first antenna module.

15. The antenna arrangement of claim 14, wherein the first antenna module and the second antenna module are positioned on a single, substantially planar substrate.

16. The antenna arrangement of claim 11, wherein the at least one antenna loop of each of the first antenna module and the second antenna module are powered substantially simultaneously.

17. The antenna arrangement of claim 11, further comprising a power splitter unit in communication with the power source and configured to split the power and simultaneously provide current to the first antenna module and the second antenna module.

18. The antenna arrangement of claim 11, further comprising at least one matching circuit in communication with at least one of the first antenna module and the second antenna module.

19. The antenna arrangement of claim 18, wherein the matching circuit is configured to transmit power to the antenna module and receive signals from the module for further transmission.

20. An antenna arrangement, comprising:

a first antenna module positioned in a plane and including:

a first antenna loop configured to emit a signal in a first spatial area;

at least one additional antenna loop configured to emit a signal in an additional spatial area;

wherein the first spatial area and the additional spatial area at least partially overlap;

a second antenna module substantially aligned with, positioned substantially in the same plane as and oriented at about 90° with respect to the first antenna module, the second antenna module including:

a first antenna loop configured to emit a signal in a first spatial area;

at least one additional antenna loop configured to emit a signal in an additional spatial area;

wherein the first spatial area and the additional spatial area at least partially overlap; and at least one power source in communication with the first antenna module and the second antenna module and configured to provide power thereto;

wherein the first antenna loop and the additional antenna loop of the first and second antenna modules are configured to be powered by the at least one power source in specified pattern.

21. A method of identifying at least one item, comprising the steps of:

(a) providing a first antenna loop positioned in a plane and configured to emit a signal in a first spatial area;

(b) providing a plurality of additional antenna loops positioned in substantially the same plane and configured to emit a signal in a respective additional spatial area;

(c) powering the first antenna loop to thereby emit a signal in a first spatial area; and (d) powering each of the additional antenna loops to thereby emit a signal in each additional spatial area;

wherein the first spatial area and each of the additional spatial areas at least partially overlap at least one other spatial area;

wherein the first antenna loop and each of the additional antenna loops are configured to be powered in specified pattern.

* * * * *